United States Patent [19]

Cho

[11] 4,050,493

[45] Sept. 27, 1977

[54] LADIES HANDBAG AND RADIO

[76] Inventor: Jin Sul Cho, G-3040 Bristol, Flint, Mich. 48507

[21] Appl. No.: 646,535

[22] Filed: Jan. 5, 1976

[51] Int. Cl.[2] ..... A45C 15/00

[52] U.S. Cl. ..... 150/35; 150/34; 325/310

[58] Field of Search ..... 150/30, 34, 35; 190/42; 325/310, 361

[56] References Cited

U.S. PATENT DOCUMENTS

| | | | |
|---|---|---|---|
| 1,793,899 | 2/1931 | Benforado | 150/34 |
| 2,055,852 | 9/1936 | Resnick | 150/34 |
| 2,467,471 | 4/1949 | Goldstein | 150/52 R |
| 2,486,536 | 11/1949 | Olson | 325/310 |
| 2,513,013 | 6/1950 | Feldman | 150/34 |
| 2,858,751 | 11/1958 | Lopez | 325/310 X |
| 3,045,900 | 7/1962 | Zekendorf | 150/35 |
| 3,144,065 | 8/1964 | Burgio | 150/35 |
| 3,557,853 | 1/1971 | Jones | 150/7 |

*Primary Examiner*—Donald F. Norton
*Attorney, Agent, or Firm*—Arnold S. Weintraub

[57] ABSTRACT

A ladies' handbag has incorporated therewith a radio or other audio emitting device. A pocket is provided in the interior of the bag in which the audio device is disposed. Suitable apertures are formed through the exterior of the handbag to permit access to the control knobs of the audio device. An exterior protector covers the apertures to prevent damage to the device and to protect it from inclement weather.

7 Claims, 4 Drawing Figures

LADIES HANDBAG AND RADIO

BACKGROUND OF THE INVENTION

1. Field of the Invention

The present invention pertains to ladies' handbags. More particularly, the present invention pertains to accessories for ladies' handbags. Even more particularly, the present invention concerns ladies' handbags having audio emitting devices incorporated therewith.

2. Prior Art

Ladies' handbags and other carrying cases have heretofore been devised with a plurality of accessories and means for incorporating these accessories into the bag. For example, U.S. Pat. No. 3,045,900 teaches a handbag having a fan and warning light incorporated therewith. In U.S. Pat. No. 1,607,007 there is taught a hand bag having a separate compartment for storing toilet and cosmetic articles. U.S. Pat. No. 1,959,675 teaches a handbag having a compartment for storing smoking articles therewithin and a complementary flap which carries matches and which closes off the compartment. In U.S. Pat. No. 2,302,560 there is taught a hand bag having a picture frame mounted on the exterior thereof. Thus, it is to be appreciated that much attention has been directed to incorporating articles into hand bags.

Because of major developments within the electronics arts, radios and other audio emitting devices, such as tape recorders and the like, enjoy great utilization. This is because of their relatively low price and portability. Thus, it is not an uncommon sight to see people in public places and at public events carrying such audio devices. Ordinarily, however, these devices are carried separate and apart from other toted items, such as hand bags and the like. Thus, it would be desirable to incorporate such audio devices into carrying cases, such as hand bags. Heretofore, there has not been developed an effective way to incorporate an audio device into a handbag which permits usage of the device without the need for opening the bag. See U.S. Pat. No. 2,513,013. The present invention seeks to overcome this situation.

SUMMARY OF THE INVENTION

In accordance with the present invention there is provided a hand bag having an audio device associated therewith. The hand bag includes a pocket or shell formed in the interior thereof. The audio device is disposed in the pocket. A plurality of apertures are formed in the exterior of the hand bag to permit access to the control knobs of the audio device. A rotatable flap is secured to the hand bag and covers the apertures to protect the audio device from banging and inclement weather. Also, the handle of the handbag can function as an antenna for a radio.

For a more complete understanding of the present invention reference is made to the following detailed description and accompanying drawing. In the drawing like reference characters refer to like parts throughout the several views, in which:

DETAILED DESCRIPTION OF THE PREFERRED EMBODIMENT

Figure 1:
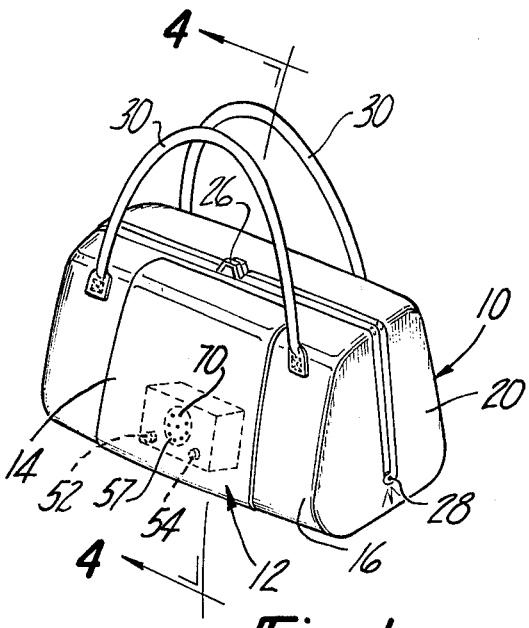
FIG. 1 is a perspective view, partly in phantom, of a hand bag and audio device in accordance with the present invention.
Figure 2:
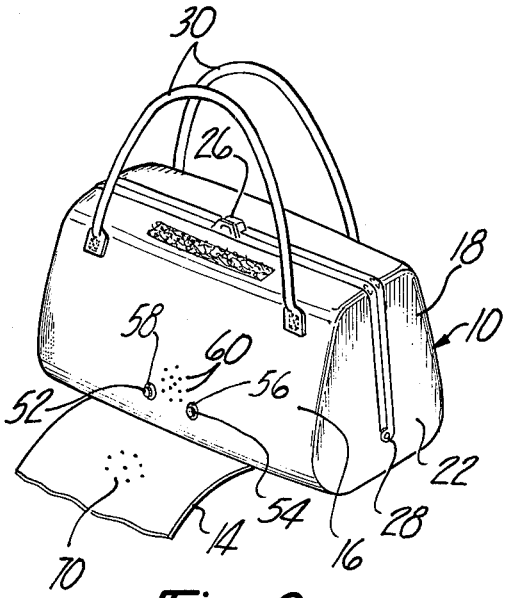
FIG. 2 is a very similar to FIG. 1 but with the protected flap in an open position.

At the outset, it should be noted that as used herein and in the appended claims, the term "audio emitting mean" is meant to include radios, tape recorders and the like. However, in order to facilitate an understanding of the present invention, the following description will be made with reference to a radio.

Now, with reference to the drawing, there is depicted therein a hand bag, in accordance with the present invention. The hand bag comprises the bag, per se, generally, denoted at 10, an audio emitting means 12 and a protective flap 14.

The bag 10 comprises a conventional hand bag or purse. As is known to those skilled in the art, such bags, generally, comprise a first outer wall 16, a second outer wall 18, a base 20 and a pair of opposed end walls 22 and 24. The walls and the base are secured together to define a unitary member having an open interior 25 in the well-known manner. Such bags further comprise a central locking mechanism, such as a latch 26, as well as, hinge means 28 provided on each end wall (only one being shown). Thus, such bags are closeable and openable to a predetermined extent. Furthermore, such bags, also, conventionally include a grasping means, such as a handle or a pair of handles 30, which is secured to the exterior of the bag.

Figure 3:
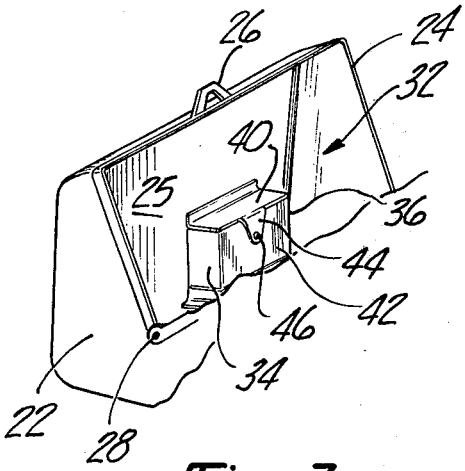
FIG. 3 is a broken, perspective view of the hand bag of FIG. 1 in an open position, with the handle eliminated for purposes of clarity.
Figure 4:
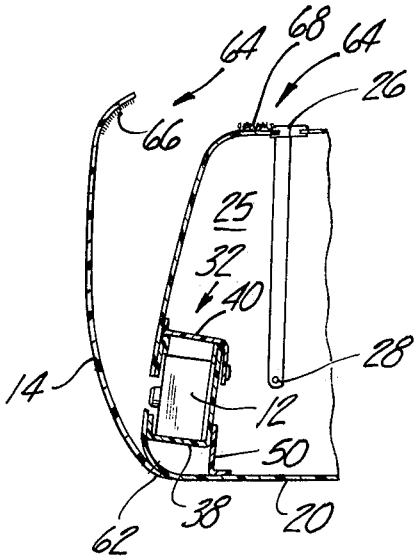
FIG. 4 is a cross-sectional view taken along the line 4—4 of FIG. 1.

As clearly shown in FIGS. 3 and 4, disposed within the interior 25 of the bag 10 is a pocket 32. The pocket comprises an interior section of the side wall 16, a pair of opposed parallel side walls 34, 36 which project inwardly from the interior side of the wall 16 and have one edge thereof secured to the sidewall 16. The pocket, also, comprises a base wall 38, a rotatable top wall 40, and an end wall 42. One edge of the top wall, the sidewalls and the base are secured to the interior of the sidewall 16. By virtue of its securement, the top wall is rendered rotatable, between a substantially horizontal position and a verticle position so that the pocket can be opened and closed. Thus, the walls cooperate with the endwall to define an enclosed pocket. Preferably, the top wall 40 includes a flexible extension 44 integrally formed therewith. The extension 44 has a snap member 46 secured thereto. The snap member 46 cooperates with a snap-receiving member 48 mounted on the exterior of the side wall 42, the enable the locking of the top wall 40, in the known manner. Thus, the snap and the receiving member provide detachable locking of the pocket.

The pocket 32 is mounted to the base 20 of the bag 10, in the interior via a bracket 50. The bracket has one portion thereof secured to the exterior of the sidewall 42 and another portion secured to the base 20 of the bag 10, as shown. Although, not critical hereto, it is to be appreciated that the pocket is elevated from the base. This prevents jostling of the audio means, which would otherwise be encountered by the picking up and placing down of the bag. The pocket 32 is provided with predetermined dimensions to removably receive therewithin the audio emitting means or radio 12.

The audio emitting means 12 is a conventional, portable, battery-type means of the type which is well-known and commercially available. Such means 12, generally, comprise audio volume control means 52 and channel or station selecting means 54. Additionally, such means 12 includes a speaker 57 It is to be understood, however, that the circuitry and construction of the audio means, do not form part of the present invention.

Referring, again to the drawing, the sidewall 16 of bag 10 is provided with apertures 56, 58. The apertures 56, 58 are in registry with and provide access to control knobs 52 and 54 associated with the audio emitting means. In this manner, station selection and volume control are readily achieved exteriorly of the pocket 32 as well as the bag 10. The sidewall 16 is, also, provided with a plurality of apertures 60. The apertures 60 are provided in the area of the speaker 57 to permit the transmissin of sound to the environment. If an AM—FM radio is utilized in accordance herewith than a further aperture can be formed in the sidewall 16 which permits access to the AM-FM switch.

In order to protect the control knobs and speaker from detrimental collisions and inclement weather, the present invention further comprises the rotatable flap 14.

The protective flap 14, which exteriorly covers the audio means, has one edge thereof 62 secured to the bag 10. Preferably, the edge 62 is secured to the bag 10 proximate the junction of the base 20 and sidewall 16. The flap 14 is provided with a length sufficient to cover the control knobs and the speaker when brought into proximity with the bag, in a manner to be described hereinafter.

The flap 14 is rendered detachably connectable to the bag 10 via means, generally, indicated at 64. Preferably, the means 64 comprises complementary woven nylon members 66 and 68. The member 66 is secured to the inner surface of the flap 14. The member 68 is disposed on and secured to the exterior of the bag 10 on the sidewall 16. The member is positioned such that upon normal rotation of the flat 14 into proximity with the bag 10, the member 66 can contact the member 68. Because of the nature of the woven nylon materials, contact between the members 66, 68 achieves detachable locking therebetween. Such woven nylon members are sold commercially under the trademark VECRO®. Of course, other modes of detachably connecting the flap 14 to the bag 10 are within the ambit of the present invention.

The flap 14 is also, provided with a plurality of apertures 70, and which is registry with the apertures 60. The apertures 70 permits the transmission of sound through the flap 14. Thus, in utilizing the present invention, after the station and volume knobs are set, the flap is brought into the position of FIG. 1 thereby fully protecting the audio device 12. The flap need only be opened to either shut-off the device 12 or change stations.

It is to be further noted with respect hereto, that an antenna for the audio means can be provided by providing a lead wire (not shown) which extends from the audio means to the handle or other metallic portion of the bag.

It is to be appreciated from the preceding that there has been described herein an effective means whereby an audio device can be safely incorporated into a hand bag without subjecting the device to numerous collisions or the like.

Having, thus, described the invention what is claimed is:

1. A combined handbag and audio emitting device, comprising, in combination:

a. a handbag having an open interior, the handbag comprising: a first sidewall, a second sidewall a pair of opposed end walls and a base, b. a pocket formed in the interior of the handbag and being integrally formed with a sidewall thereof, the pocket comprising a pair of opposed sidewalls, a portion of the first sidewall of the handbag, a rotatable top wall, a base and an end wall, the edge of each of the sidewalls, the top wall and the base are secured to the first sidewall of the handbag above the bag thereof such that the pocket is elevated above the base thereof, the pocket being dimensioned to receive an audio emitting device therewithin, c. an audio emitting device disposed within the pocket, the device comprising a volume control means and a station selecting means, d. means formed through the handbag for permitting access to the volume control means and station control means exteriorly of the handbag, while the audio emitting device is disposed in the pocket, and e. a mounting bracket extending between the end wall of the pocket and the base of the handbag.

2. The combination of claim 1 which further comprises:

a. a protective flap having one end thereof secured to the exterior of the hand bag and covering the audio emitting device, and b. means for detachably connecting an opposite end of the flap to the hand bag.

3. The combination of claim 2 wherein:

the means for detachably connecting comprises a woven nylon member secured to the flap and a complementary woven nylon member secured to the handbag, the nylon members being engagable to detachably connect the flap to the handbag.

4. The combination of claim 1, wherein:

the access means comprises a plurality of apertures formed through the handbag, each one aperture being in registry with one of the control means and station selecting means.

5. The combination of claim 1 which further comprises:

means for detachably locking the top wall of the pocket to the end wall of the pocket.

6. The combination of claim 1 wherein:

a. the audio emitting device further comprises a speaker, and b. the hand bag has a plurality of apertures formed therethrough proximate the speaker to permit the transmission of sound therethrough.

7. A combined handbag and audio emitting device, comprising, in combination:

a handbag having an open interior and comprising a first sidewall, a second sidewall, a pair of opposed end walls and a base, a pocket disposed in the interior of the handbag, the pocket comprising a pair of opposed sidewalls, a portion of the first sidewall of the handbag, a rotatable top wall, a base and an end wall, an edge of each of the sidewalls, the top wall and the base of the pocket being secured to the first sidewall of the handbag such that the pocket is elevated above the base of the handbag, a mounting bracket extending between the end wall of the pocket and the base of the handbag, audio emitting means disposed in the pocket, the audio emitting means comprising a volume control means and a station selecting means, and means formed through the handbag for permitting access to the volume control means and station control means exteriorly of the handbag.

* * * * *